United States Patent [19]

King et al.

[11] Patent Number: 4,993,574

[45] Date of Patent: Feb. 19, 1991

[54] CARGO CONTAINER WITH IMPROVED PANELS

[76] Inventors: Edgar King, 206, 1363 Clyde Ave., West Vancouver B.C., Canada, V7T 2W9; Peter Watson, 6430 Larch Street, Vancouver B.C., Canada, V6M 4E9

[21] Appl. No.: 525,689

[22] Filed: May 21, 1990

[51] Int. Cl.[5] ..... B65D 6/28

[52] U.S. Cl. ..... 220/1.5; 220/668; 220/683

[58] Field of Search ..... 220/1.5, 4.28, 668, 220/683

[56] References Cited

U.S. PATENT DOCUMENTS

| | | | |
|---|---|---|---|
| 2,956,705 | 10/1960 | Clingman | 220/80 |
| 3,633,790 | 1/1972 | Voss | 220/668 X |
| 3,712,504 | 1/1973 | Petersen | 220/84 |
| 3,784,043 | 1/1974 | Presnick | 220/84 X |
| 3,955,702 | 5/1976 | Lundy | 220/4 F |
| 3,972,437 | 8/1976 | Lovich et al. | 220/4 R |
| 3,989,157 | 11/1976 | Veenema | 220/84 |
| 4,558,797 | 12/1985 | Mitchell | 220/4 F |
| 4,731,973 | 3/1988 | Stenemann | 52/282 X |
| 4,770,312 | 9/1988 | O et al. | 220/4 F |
| 4,795,047 | 1/1989 | Dunwoodie | 220/668 X |
| 4,802,600 | 2/1989 | Bretschneider et al. | 220/668 X |
| 4,936,477 | 6/1990 | King et al. | 220/1.5 |

*Primary Examiner*—Steven M. Pollard

*Attorney, Agent, or Firm*—Shlesinger & Myers

[57] ABSTRACT

A cargo container which includes a plurality of elongated frame members each having an outer surface and an interior region opposite the outer surface, two elongated channels opening to the interior region on either side edge of the frame member and an elongated recess adjacent to and parallel with each of the channels. A plurality of coupling members are removably engagable with ends of the frame members and a plurality of panels are affixed to openings defined by the frame members. Panel edging is affixed around a periphery of each of the panels. The edging has a projecting portion removably insertable into the channels and an elongated recess around the perimeter thereof such that, when said edging is engaged with corresponding channels in said frame members, the edging recess in combination with corresponding recesses of said frame members form an elongated slot around the perimeter of said edging. An inclined wall portion couples the projecting portion to a panel receiving portion of the edging such that an associated panel attached to the panel receiving portion of the edging is substantially flush with the outer surface of said frame members. A resilient strip is insertable into each of the slots for removably affixing each of the panels to the frame members such that edges of the panels may reversibly move slightly against only the compression resistance of a corresponding resilient strip.

20 Claims, 6 Drawing Sheets

CARGO CONTAINER WITH IMPROVED PANELS

BACKGROUND

The present application is related to U.S. Pat. application Ser. No. 07/400,710 filed Aug. 30, 1989.

This application relates to an improved cargo container adapted for use for either air or ground transport having components which are simple to assemble and disassemble and a construction which is tolerant of flexing and deformation of the panels and frame.

The use of transparent panels is disclosed by U.S. Pat. No. 4,833,771 issued May 30, 1989 to Dunwoodie. These panels are held by inner and outer corner moldings and therefore require custom fabrication of the edges of the panels to accommodate the shape of the inner and outer molds. Such processing of the panel edges necessarily introduces stresses in the panel edges which can lead to failure of the panels during use. Nuts and bolts are used to attach the inner and outer corner moldings together over the panel edges.

A shipping container capable of being assembled without tools, ie. without nuts and bolts or other like fasteners, is disclosed in U.S. Pat. No. 3,517,849 issued to Presnick. Presnick uses extruded frame members with elongated slots to receive the edges of a rigid panel and corner members with legs to fit into the hollow ends of the extruded frame elements. The frame elements matingly couple to each other so that a panel enclosed by frame elements and corner members interlocks with a panel and surrounding frame element and corner members corresponding to each one of the elongated edges of the panel. The Presnick assembly is not water tight at the edges proximate the corner pieces since it is not cemented to the corner pieces. Moreover, the latter assembly is not highly deformation tolerant as deformation puts a strain on the edge joints and the rigid panels themselves. Finally the panels of Presnick can not be removed without first disassembling at least in part the frame structure.

Italian Pat. No. 623,118 issued July 7, 1961 to J. Langham Thompson Group Limited discloses a knockdown container assembly with corner pieces having legs dimensioned to fit into the ends of extruded frame elements and panels which are attached by screws to the extruded frame elements. The corner pieces consist of an outside rounded piece with a bolt and the inner corner piece with a bolt hole and a nut threaded onto the bolt to hold the inner and outer corner piece together.

The utilization of rigid panels with edges either glued to the frame elements or fastened thereto with screws makes the known cargo containers susceptible to fracture of the panels or failure of the edge joint on being deformed in response to an applied load. Since it is common practice to apply large loads to the inside walls during filling of a container which can cause deformation of the container and subsequent failure, such assemblies tend to have a relatively limited life when used as airline, truck or ship containers.

Accordingly, it is an object of the present invention to provide an improved cargo container. It is yet a further object of the invention to provide such a container that is better able to withstand deformation than hitherto known containers. Yet another object of the invention is to provide a container which is substantially water tight.

STATEMENT OF THE INVENTION

According to the invention there is provided a cargo container which includes a plurality of elongated frame members each having an outer surface and an interior region opposite the outer surface. The frame members also have two elongated channels opening to the interior region on either side edge of said frame member and an elongated recess adjacent to and parallel with each of the channels. Removably engaged with ends of the frame members are a plurality of coupling members. A plurality of panels with edging affixed around perimeters thereof are each insertable into channels in coupled ones of the frame members. The edging has a projecting portion removably insertable into the channels and when the edging is inserted into the corresponding channels in the frame members, an edging recess in combination with a contiguous, corresponding recess in the frame member forms an elongated slot around the perimeter of said edging. An inclined wall portion of the edging couples the projecting portion to a panel-receiving portion of the edging such that an associated panel attached to the edging panel receiving portion is substantially flush with the outer surface of the frame members. A resilient strip is insertable into each of the slots for removably affixing each of said panels to the frame members such that edges of said panels may reversibly move slightly against only the compression resistance of a corresponding resilient strip.

Tension loads experienced by the panel 52 are transmitted linearly into the outer surface of the frame member 26 via the inclined wall portion 98 and the outer lip 94.

Advantageously, the channels are located on the interior of the container to enhance security. Such an assembly avoids the need for using fasteners such as nuts and bolts which are time consuming and provides an easily assembled or disassembled structure.

A resilient strip is used for removably affixing the panels to the frame members and coupling members around the perimeter of the openings. The use of a resilient strip for affixing the panels to the frame and coupling members not only avoids the need for separate fasteners such as nuts and bolts but also beneficially introduces a tolerance to bending or flexing of the structure not otherwise available.

The panel includes a flexible sheet with a semi-rigid panel frame affixed around its edges. Use of a flexible sheet rather than a rigid sheet avoids the susceptibility of fracture of the panels due to deformation of the container and makes the structure more deformation tolerant. Moreover, no drilling of the panel edges is required so that the panel is not compromised or stressed by such treatment.

The resilient strip is preferably located on the interior of the container and may advantageously be hollow to reduce its weight and increase its compressibility.

The frame members may be hollow extruded aluminum with a pair of elongated rounded recesses for receiving rounded strips or O-Rings and having a channel with an outer sidewall sloped back slightly towards an inner wall thereof to form an angle with the base of the channel of slightly less than 90 degrees. The panel edging has spaced apart legs insertable into corresponding channels of the frame members, the outer leg having a sidewall abutting and parallel to the outer sidewall of the frame member channel. Tension and compression loadings in the plane of the panel and loadings in both directions normal to the panel plane each result in resilient transmission of the load into the frame member. As the component loads increase the shapes of the panel edging and frame member cause the panel to be progressively more firmly connected to the frame member.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
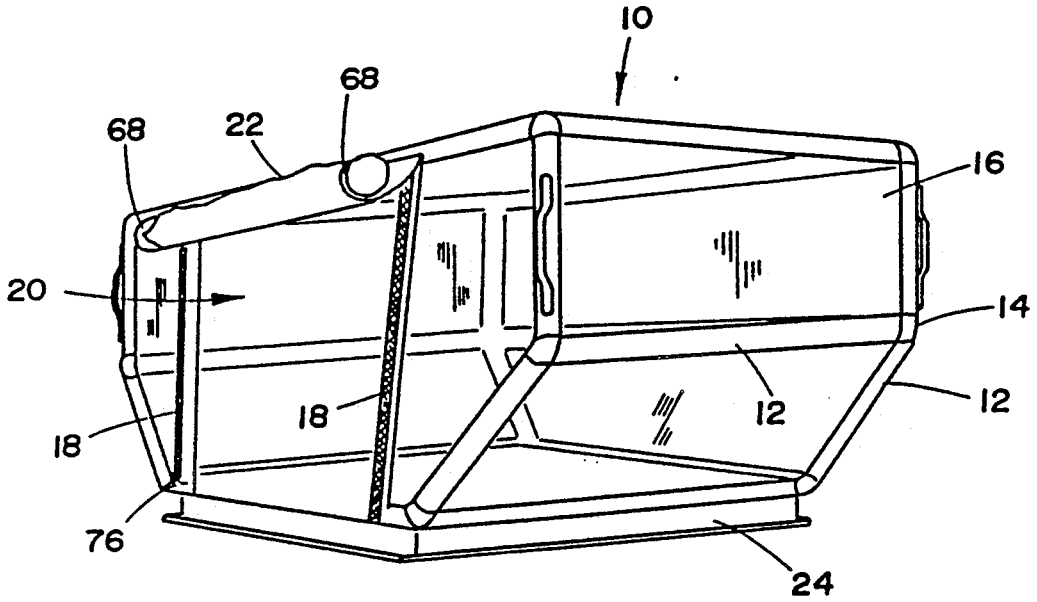
FIG. 1 is a perspective view of the container.

Referring to FIG. 1 there is shown a cargo container 10 made up of a plurality of frame members 12 coupled to adjacent frame members 12 by couplers 14. In each open area defined by coupled frame members and couplers 14 there is attached a transparent rectangular panel 16. On one side of the container 10 there is an opening 20 and a roll-up door 22 releasably attachable to fibre attachment strips sold under the trademark Velcro* along either side of the opening 22. The entire top structure of the container 10 is removably fastenable by means of nuts and bolts to a base 24.

Figure 2:
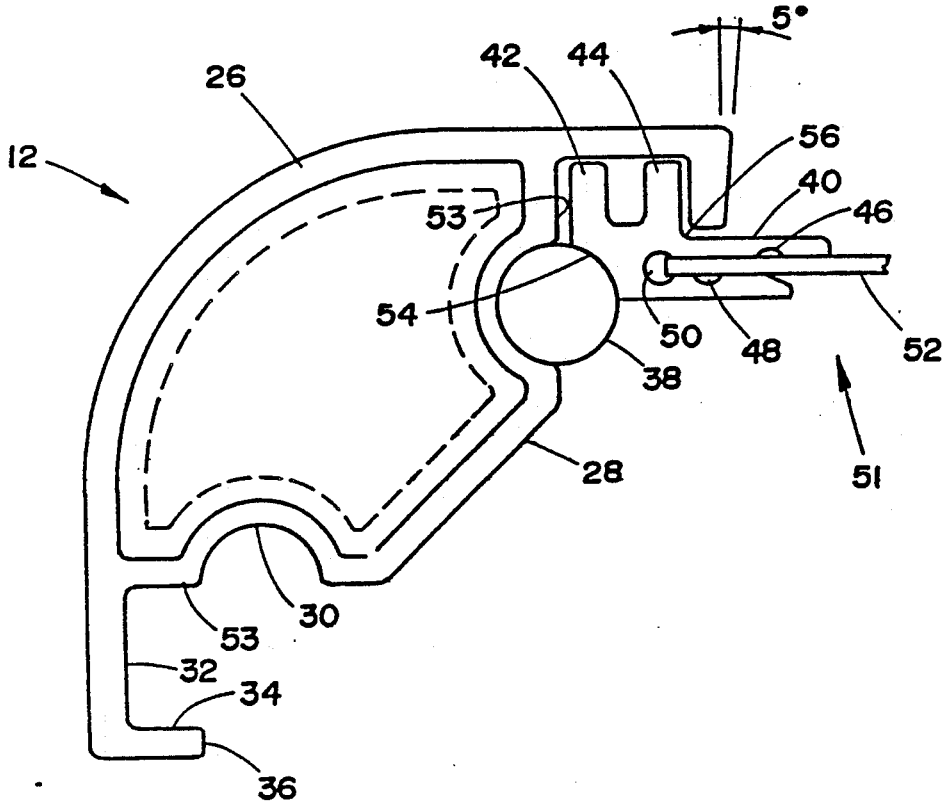
FIG. 2 is an end view of a frame member with a panel edge portion and panel frame in cross-section shown held in place by an O-Ring.

The cross section of a frame member 12 is shown in FIG. 2 as being a hollow extruded aluminum structure. The member 12 is for use at the intersection of two panels 51 (only one of which is shown) intersecting at right angles. In this case arc section 26 describes a quarter circle whereas for other angles of intersection the arc section would describe a different sector of a circle. At either end of arc section 26 there is a rounded, elongated recess 30 joining an end of arc section 26 to a diagonal section 28. Also at each end of arc section 26 there is an extension 32 tangent to arc section 26 terminating in a substantially orthogonal lip 36 having an inner wall 34 sloped back slightly from 90 degrees to arc section 26 by 1/32 inches in ⅜ inches distance or about 5 degrees.

Each panel 51, only a portion of which is shown in FIG. 2, is a transparent flexible plastic sheet 52 glued around its perimeter to a rigid perimeter edging 40. Edging 40 has slot enlargements 46, 48 and 50 which serve as glue channels and a pair of spaced apart lips 42 and 44 projecting substantially at right angles to the plane of panel 52. Lip 44, however, is sloped outwardly about 5 degrees to match the slope of the inner wall 34 of lip 36. The total width of lips 42 and 44 is chosen to be less than the width of extension 32 so that edging 40 can rotate slightly about a contact point 56 with lip 36 in a counterclockwise direction as viewed in FIG. 2 without contacting wall 53. Edging 40 also has a rounded, elongated recess 54 so that in combination with recess 30 of frame member 12 there is provided a circular O-Ring slot subtending about 270 degrees for a resilient O-Ring 38. With O-Ring 38 in place edging 40 is held within the channel 31 formed by extension 32 and walls 53 and 34 with lip 44 abutting inner wall 34.

An outwardly directed load applied to panel 51 results in outward movement of sheet 52 and a torque applied to perimeter frame 40 about an axis coinciding with line 56. Lips 42 and 44 move toward wall 53 and compress further O-Ring 54 which resists the deformation of frame 40.

Figure 3:
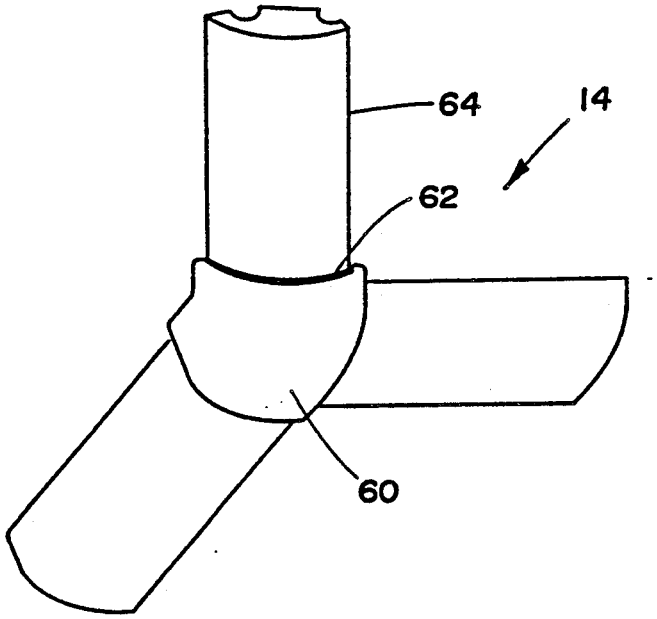
FIG. 3 is a perspective view of an exterior surface of a frame member coupler.
Figure 4:
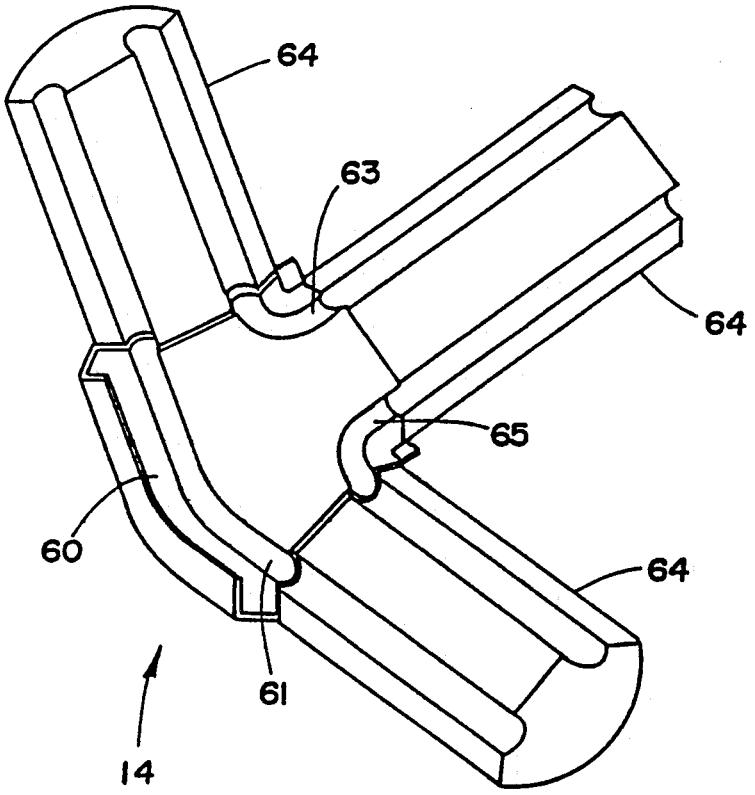
FIG. 4 is a perspective view of an interior surface of a frame member coupler.

A coupler 14 for coupling together frame members 12 is shown in FIG. 3 as including an enlarged section 60 integral with three different legs 64 each having a cross-section designed to fit inside an associated frame member 12 as shown in the dotted outline of FIG. 2 with a shoulder 62 between the two abutting an end of each frame member 12. As shown in FIG. 4 each coupler has grooves 61, 63 and 65 which align with corresponding grooves 30 in the frame members 12. The couplers 14 are made of metal or rigid plastic such as polycarbonate or polyurethane. The plastic material will return t its original shape after deformation.

Figure 5:
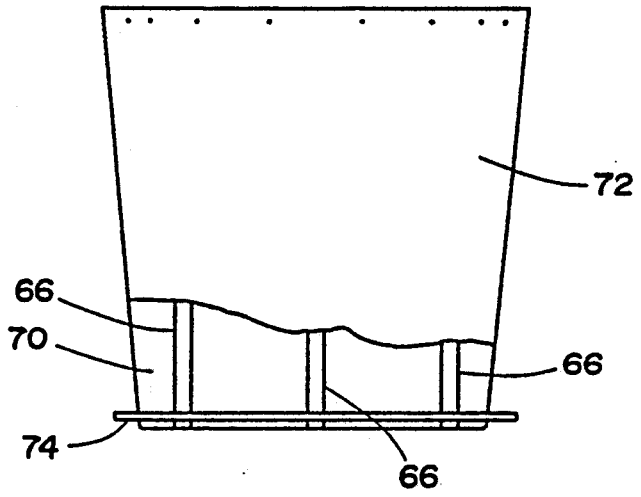
FIG. 5 is a perspective view of the door covering with the outer lining partially broken away and a corner of the inner lining also broken away.

Door opening 20 is covered by a roll-up door 22 shown in more detail in FIG. 5. Door 22 is made of 2 sections 70 and 72 of flexible sheet material sewn together to enclose springs 66 along each side and the center. Springs 66 are made of stainless steel tempered to a coiled up equilibrium position so that when enclosed they tend to cause cover 22 to roll up into a coiled position. A pair of fibre attachment strips 68 fastened to the interior of door 22 align with corresponding strips 18 along the sides of opening 20 and attach to the latter to hold the door 22 in a closed position until the corresponding fibre attachment strips 18 and 68 are released from each other. A crossbar 74 located proximate a bottom end of door 22 fits into crossbar sockets 76 on either side of opening 20 on container 10 when the door is unrolled.

Figure 6:
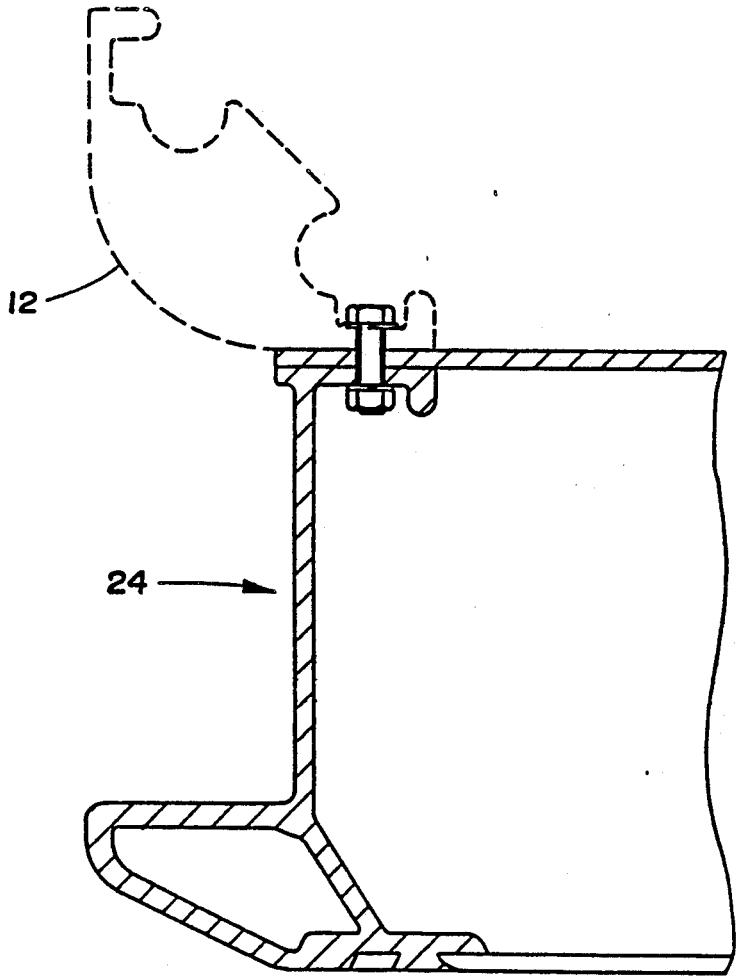
FIG. 6 is a cross-sectional view of the base and frame member connection thereto.

As shown in FIG. 6, the bottom extruded frame members 12 are bolted to a base 24 to complete the structure of the container 10. The entire container 10 with the exception of the base 24 and door suspension attachment is assembled without fasteners such as nuts and bolts. Assembly of the container proceeds from the base and progresses upwardly. The bottom layer of frame members are coupled together with couplers 14 and then upwardly directed frame members are slid onto corresponding legs 64. Once all of the frame members are assembled the bottom layer is bolted onto base 24. Following bolting of the bottom layer to base 24, the transparent panels 51 are set in place from the interior of the container 10 and then the resilient O-Rings are inserted into O-Ring grooves 30 and corresponding ones of 61, 63 and 65 on couplers 14. The top of the door is fastened to the top of the container 10 to complete the assembly. The entire structure can be rapidly disassembled for shipment and then reassembled once it reaches its destination.

Figure 7:
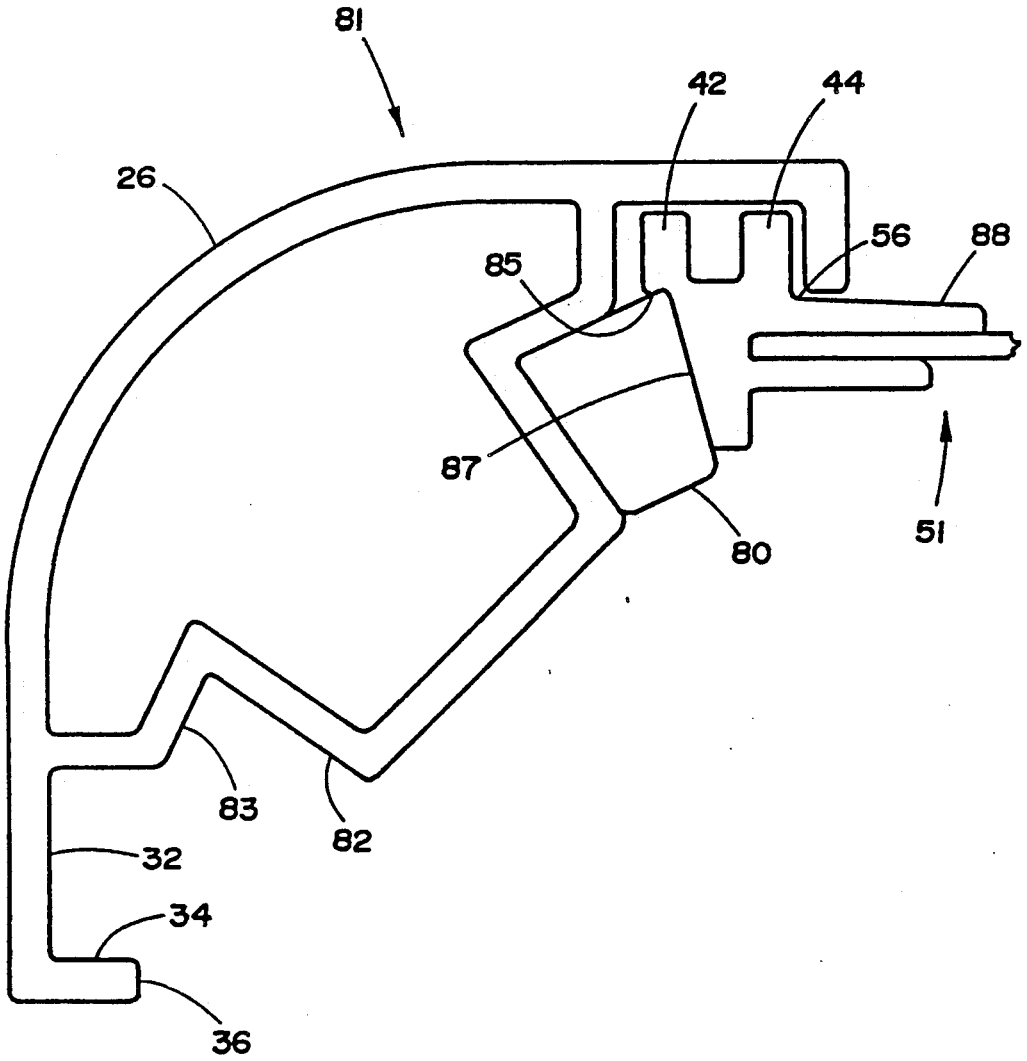
FIG. 7 is a cross-sectional view of an alternative embodiment of the frame member.

An alternative variant of the frame members and couplers is shown in cross section in FIG. 7. In this case the O-Ring 80 is trapezoidal as is the groove formed by walls 82 and 83 of frame member 81 and surfaces 85 and 87 of perimeter frame 88. Other similar variants are obviously possible.

Figure 8:
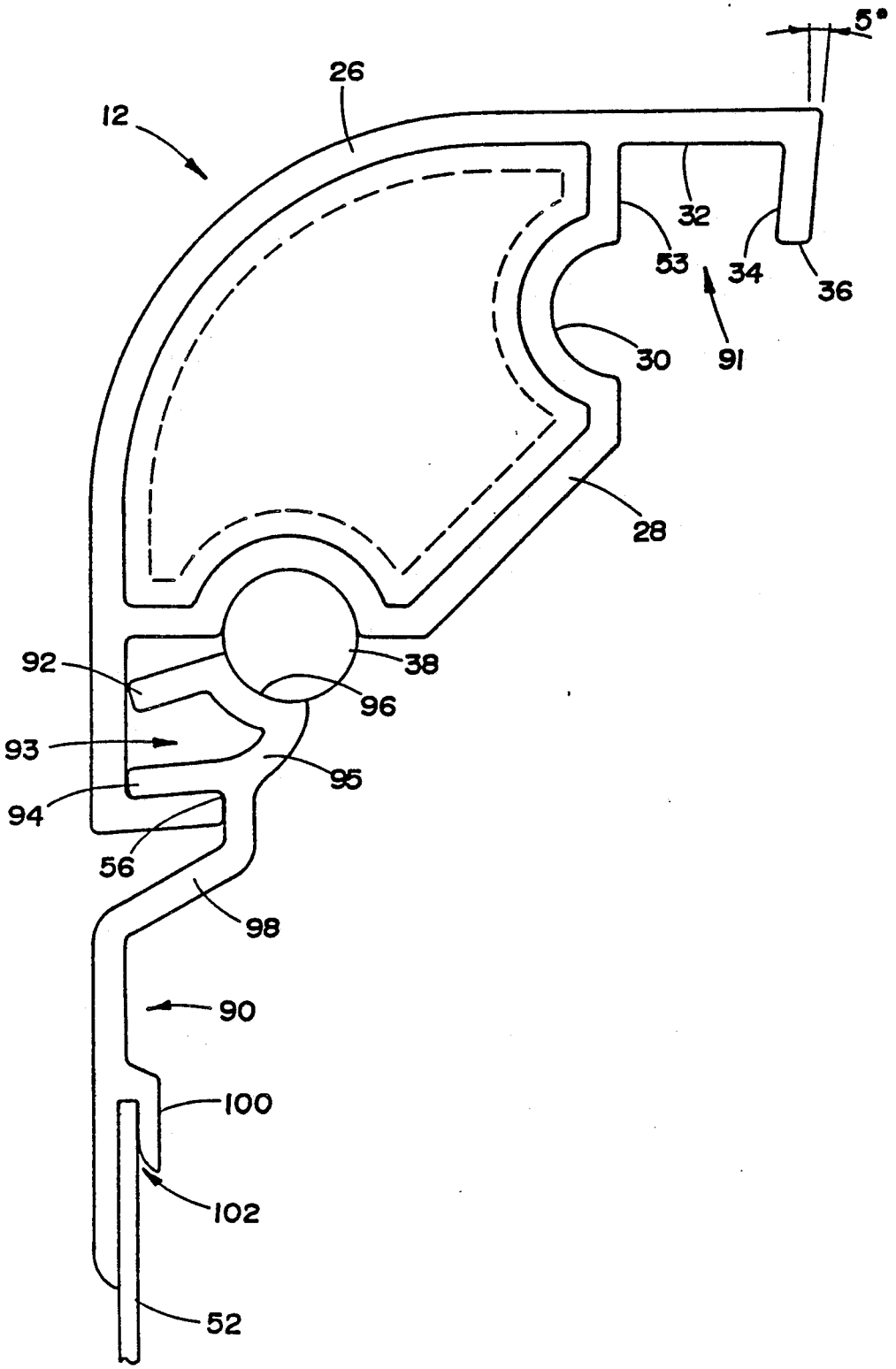
FIG. 8 is a cross-sectional view of another alternative embodiment in which the edging is formed so that the panels are flush with the outer surface of the frame members.

Yet another variant of the frame members is shown in FIG. 8, in which an alternative perimeter edging 90 is employed. Edging 90 includes a rounded recess 96 for abutting O-ring 38, and a projecting head 93 formed by an inner and an outer lip 92 and 94, respectively, rounded recess 96 and a connecting arm 95. Lips 92 and 94 are insertable into a channel 91 formed by inner wall 53, extension wall 32 and lip wall 43 of lip 36. An angled wall portion 98 connects the projecting head 93 to a panel receiving portion 100 having a slot 102 which receives the panel 52. Again the flexible panels 52 are glued into slot 102 in portion 100. Thus, panels 52 are positioned to be substantially flush with the outer surface of the frame members 26 thereby avoiding or largely minimizing water capture by the panel areas when used in positions such as for the roof of a structure. Both the sheet or panels 52 and semi-rigid edging 90 are polycarbonate. Such similarity of materials enhances the glue bond between the two.

The presence of angled wall portion 98 provides significant unexpected advantages in terms of resistance to panel loads. Examining the mode of transmission of loads arising in the panel 52 into the frame member 26, in turn:

(i) Loads in the plane of the panel 52 towards frame member 26 result in compression of "O" ring 38 initially, followed by flexing of the angled wall portion 98 about fulcrum point 36. As the panel 52 is also flexible it will deform before the angled portion 98 becomes parallel with outer lip 94.

(ii) Loads in the plane of the panel 52 away from frame member 26 are transmitted linearly from the panel 52 into the frame member 26 without creating a torque about contact point 56 because of the rigidity of the edging 90. There is a tightening of the contact between the outer lip 94 and the lip wall 34. As the tension loads increase flexing of the angled wall portion 98 occurs as it tends towards alignment with the plane of the panel 52. A torque then develops about contact point 56 and ultimately the projecting head 93 first compresses and then dislodges the resilient "O" ring 38. The panel with its edging then comes away from the frame member.

Figure 9:
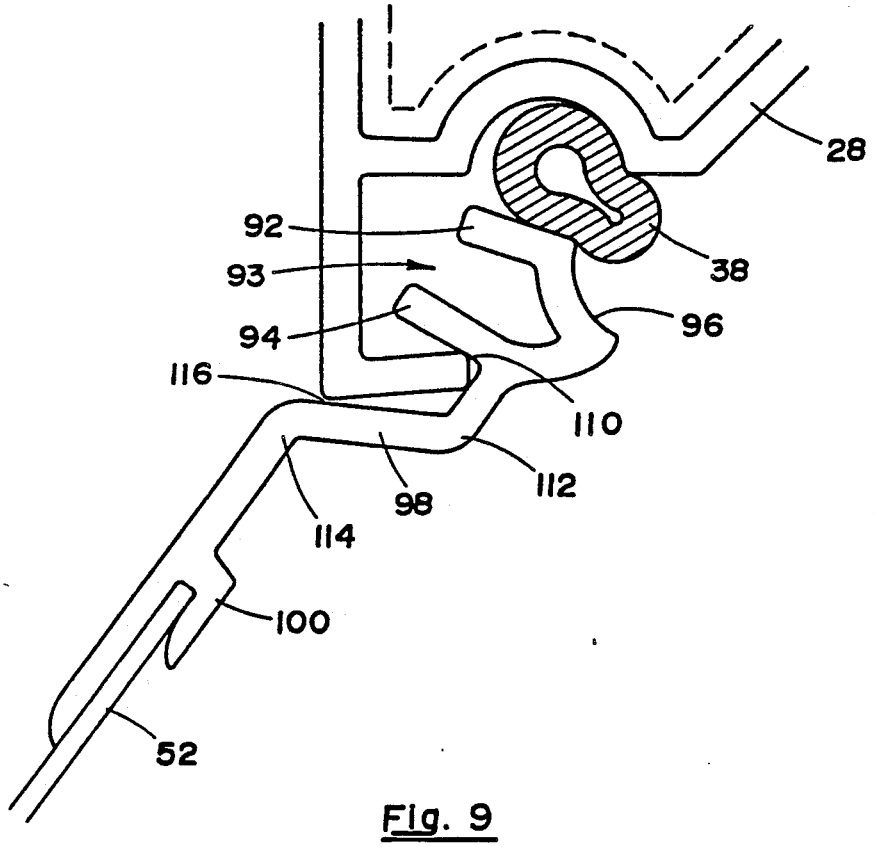
FIG. 9 is a partial cross sectional view of the embodiment of FIG. 8 showing the deformation in response to loads normal to the panel.

(iii) Loads normal to the plane of panel 52 from the right to the left as shown in FIG. 9 result in clockwise rotation of the projecting head 93 about the fulcrum point 36. This compresses the "O" ring 38. Before the rotation is such that the projecting head 93 squeezes past "O" ring 38, and the panel is dislodged, the outer lip 94 and the angled wall portion 98 jam (at points 110 and 116) at each end of lip 36. Higher loads then cause no further rotation of projection head 38 but a deformation of the panel edging at fulcrum point 114, and ultimate failure at this point. The effect of this is that even though high loads in two directions can be sustained without component failure the "O" ring is not dislodged. When the load is relaxed the projecting head 93 is forced back into its original position by the "O" ring.

(iv) Loads normal to the plane of the panel 52 from the left to the right in FIG. 9 cause portion 98 to rotate counterclockwise. Such rotation causes the projecting head 93 to rotate so as to further lock resilient "O" ring 38 more firmly in place. Ultimate failure is at point 112.

The perimeter edging 90 can, therefore, sustain significantly greater ultimate loads than the unit described in FIG. 2, especially in the directions (ii) and (iii) above, and, at the same time, allow for more flexibility in the structure when subjected to load from any of the four directions. These loadings may also occur through thermal expansion and contraction in addition to mechanical impacts.

Clearly, various container shapes other than that of FIG. 1 are possible to conform to the vehicle into which the container is loaded.

Obviously, metal panels can be substituted for the flexible plastic ones although with some loss of deformation tolerance.

The resilient O-ring or strip 38 can be replaced by a rigid or semi-rigid bar or tube inserted into the ends of each extruded frame member with one of the two couplers removed. Although reduced tolerance to deformation is achieved the assembly is still simple to assemble and disassemble when used in this way.

Figure 10:
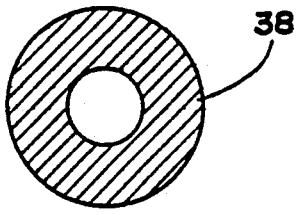
FIG. 10 is a cross sectional view of a hollow O-ring.

Alternatively, O-ring 38 may be hollow as shown in FIG. 10 in order to decrease its resistance to deformation.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall with the true scope of the invention.

We Claim:

1. A cargo container, comprising:

(a) a plurality of elongated frame members each having an outer surface and an interior region opposite said outer surface, two elongated channels opening to said interior region on either side edge of said frame member and an elongated recess adjacent to and parallel with each of the channels;

(b) a plurality of coupling members removably engagable with ends of said frame members;

(c) a plurality of panels;

(d) panel edging affixed around a periphery of each of said panels, said edging having a projecting portion removably insertable into the channels in coupled ones of said frame members and an elongated recess around the perimeter thereof such that, when said edging is engaged with corresponding channels in said frame members, the edging recess in combination with corresponding recesses of said frame members form an elongated slot around the perimeter of said edging;

(e) an inclined wall portion coupling said projecting portion to a panel receiving portion of said edging such that an associated panel attached to said edging panel receiving portion is substantially flush with the outer surface of said frame members; and (f) a resilient strip insertable into each of said slots for removably affixing each of said panels to said frame members such that edges of said panels may reversibly move slightly against only the compression resistance of a corresponding resilient strip in response to loads applied to said panels from within the container.

2. A container according to claim 1, wherein said inclined wall portion is at an angle to said panel such that tension exerted by said panel on said edging panel receiving portion is transmitted linearly into the outer surface of said frame member via the said inclined wall portion and an outer lip defining an outer wall of said channel.

3. A container according to claim 1, wherein said panel includes a flexible sheet affixed around its edges to a semi-rigid perimeter edging.

4. A container according to claim 3, wherein said edging and said frame member have opposed abutting surface portions which permit limited rotation of said edging relative to said frame member against a resisting force provided by compression of said resilient strip in response to a load applied to an associated one of said panels.

5. A container according to claim 4, wherein said panels are transparent, translucent or opaque plastic.

6. A container according to claim 1, wherein said projecting portion includes a leg insertable into an associated one of said channels and being sufficiently narrower than said one channel such that said projecting portion is rotatable about an outer lip defining an outer wall of said channel against compression resistance of a resilient strip inserted into said slot.

7. A container according to claim 1, wherein said elongated slot is part-circular in cross-section.

8. A container according to claim 1, wherein said resilient strip is hollow.

9. A container according to claim 1, wherein said resilient strip is on a side of said frame members interior of said container.

10. A cargo container, comprising:

(a) a plurality of elongated frame members each having an outer surface and an interior region opposite said outer surface, two elongated channels opening to said interior region on either side edge of said frame member and an elongated recess adjacent to and parallel with each of the channels;

(b) a plurality of coupling members removably engagable with ends of said frame members;

(c) a plurality of panels;

(d) panel edging affixed around a periphery of each of said panels, said edging having a projecting portion removably insertable into the channels in coupled ones of said frame members and an elongated recess around the perimeter thereof such that, when said edging is engaged with corresponding channels in said frame members, the edging recess in combination with corresponding recesses of said frame members form an elongated slot around the perimeter of said edging;

(e) an inclined wall portion coupling said projecting portion to a panel receiving portion of said edging wherein the angle between said projecting portion and said panel is such that a load applied to said panel results in substantial component of force resulting from that load being normal to said projecting portion; and (f) a resilient strip insertable into each of said slots for removably affixing each of said panels to said frame members such that edges of said panels may reversibly move slightly against only the compression resistance of a corresponding resilient strip in response to loads applied to said panels.

11. A container according to claim 10, wherein said inclined wall portion is at an angle to said panel such that said panel is flush with the outer surface of said frame members adjacent thereto.

12. A container according to claim 10, wherein said projecting portion includes a pair of spaced apart legs.

13. A container according to claim 10, wherein said edging is semi-rigid and said panel includes a flexible sheet affixed around its edges to said rigid edging.

14. A container according to claim 10, wherein the channel is defined by an outer lip having an outer wall, an extension wall substantially normal to said outer lip and an inner wall of the channel and a leg of said projecting portion is positionable adjacent to said outer lip with both angled slightly toward the inner wall of said channel away from being perpendicular to said panel.

15. A container according to claim 10, wherein said resilient strip is hollow.

16. A cargo container, comprising:

(a) a plurality of hollow, elongated, extruded frame members each having a pair of elongated channels on either side of said frame members and a rounded recess adjacent to each of said channels;

(b) a plurality of coupling members having bosses of a cross-section to be matingly slidably insertable into ends of said frame members;

(c) a plurality of panels insertable into the channels in coupled ones of said frame members each panel including a flexible transparent sheet and rigid edging affixed around the perimeter of said sheet, said rigid edging having a pair of legs insertable into said channels, a recess substantially contiguous with said frame member rounded recess a panel receiving portion and an inclined portion joining said legs to said panel receiving portion such that said transparent sheet is positioned substantially flush with the outer surface of said adjacent frame members and tension on said edging is transmitted linearly into the outer surface of the frame member; and (d) resilient O-Ring insertable into said frame member and coupling member recesses such that said panels are held in place by said strips.

17. A container according to claim 16, wherein said panel includes a flexible sheet affixed around its edges to a rigid perimeter frame.

18. A container according to claim 16, wherein said O-Ring strips are on a side of said frame members interior of said container.

19. A container according to claim 16, wherein said edging and said frame member have opposed abutting retaining walls portions each angled slightly toward an inner wall of said channel which permit limited rotation of said perimeter frame relative to said frame member against a resisting force provided by compression of said resilient O-Ring.

20. A container according to claim 16, wherein said resilient strip is hollow.

* * * * *